US005896689A

United States Patent [19]

Bassouls et al.

[11] Patent Number: 5,896,689

[45] Date of Patent: Apr. 27, 1999

[54] BILL POSTING DEVICE

[75] Inventors: Pierre-Henry Bassouls, Montrottier; Eric Bihr, Meys, both of France

[73] Assignee: J.P.N. Fixations S.A., France

[21] Appl. No.: 08/731,609

[22] Filed: Oct. 16, 1996

[30] Foreign Application Priority Data

Oct. 16, 1995 [FR] France ..... 95 12317

[51] Int. Cl.[6] ..... G09F 17/00

[52] U.S. Cl. ..... 40/603; 40/790; 40/792

[58] Field of Search ..... 40/603, 790, 792, 40/514, 515, 517, 518; 229/68.1, 71

[56] References Cited

U.S. PATENT DOCUMENTS

| | | | |
|---|---|---|---|
| 5,040,586 | 8/1991 | Hillstrom | 40/603 X |
| 5,301,447 | 4/1994 | Lotter et al. | 40/603 |
| 5,359,797 | 11/1994 | Williamson | 40/517 X |
| 5,373,655 | 12/1994 | Suzuki | 40/603 |
| 5,398,436 | 3/1995 | Suzuki | 40/604 X |
| 5,647,155 | 7/1997 | Hillstrom | 40/603 |

FOREIGN PATENT DOCUMENTS

| | | |
|---|---|---|
| 0294301 | 12/1988 | European Pat. Off. . |
| 0564657 | 10/1993 | European Pat. Off. . |
| 2428884 | 1/1980 | France . |
| 4133591 | 4/1993 | Germany . |
| 9314759 | 2/1994 | Germany . |
| 8808601 | 11/1988 | WIPO . |

*Primary Examiner*—William Stryjewski
*Attorney, Agent, or Firm*—Wall Marjama Bilinski & Burr

[57] ABSTRACT

Apparatus for posting bills that includes a frame containing a window region. A transparent outer film is mounted in the window and coacts with a back film to establish a wallet that is open along one edge for receiving a bill therein. The window has apparatus associated therewith for securing and tensioning the wallet inside the window.

9 Claims, 7 Drawing Sheets

BILL POSTING DEVICE

TECHNICAL FIELD

The invention is aimed more specifically at a type of bill posting device in which bills made of paper or the like can be changed at will.

PRIOR ART

Described in document FR-A-2 428 884 is a type of bill display cabinet composed of a case forming a showcase, the front face of which is made of a transparent material, generally glass. This front face is mounted on hinges so that it can pivot about its upper edge. Several hooks are formed inside the box, at the top, to allow the bill to be attached by its top part. When changing the bill, this showcase needs to be opened and the front face pivoted in order to access the upper hooks. As the front face is generally made of thick glass, it is therefore heavy and the maneuvers require certain precautions to be taken to keep it open. Furthermore and above all, the cost of such display cabinets proves extremely high.

Another type of bill display cabinet, as especially illustrated in document EP-A-0 646 904 is also known. This bill posting device includes a main surround inside which there is a rigid panel. This rigid panel is intended to take the bill over the top of which is stretched a transparent film intended to press the bill against the rigid rear face. In order for it to press effectively, the tension in the rigid film has to be exerted slightly toward the back of the rigid rear face. This means that the space between the film and the rear face is almost non-existent, which prevents the posting of the bill using any type of practical means such as hooks or lath-type hangers.

Furthermore, in the case of the use of surrounds which includes a light box allowing the bill to be backlit, the presence of the rigid rear face greatly affects the accessibility to the lighting means. Furthermore, only the use of rear faces made of cellular polycarbonate allows the qualities of sufficient mechanical inertia allied with adequate transparency to be obtained. Unfortunately, the very cellular nature of this material leads to light diffraction phenomena which generate lines of shadow on the backlit bill and impair the quality of the image.

The problem which the invention sets out to solve is that of dispensing with this rigid rear face, while maintaining the mechanical qualities of sufficient and bill retention sufficient transparency.

DESCRIPTION OF THE INVENTION

The objective at which the invention is aimed is to provide a bill posting device which is easy to use and to maintain, having good qualities of transparency and of bill retention, and reduced manufacturing cost.

The invention therefore relates to a bill posting device, of the type including a frame forming a surround inside which a bill is arranged, and a transparent outer film for protecting the bill, said outer film being stretched over the surround or window.

This device is one wherein:

the outer film is associated with a second, back, film for forming a wallet, closed on three sides, intended to take the bill, said wallet has a reinforced peripheral region connecting the outer film and the back film, and having means for securing to the surround, and the surround has means capable of interacting with the securing means of the wallet, in order to tension the wallet.

In other words, the bill is inserted inside a wallet which is itself stretched over a surround. The bill is therefore pressed between the back film and the outer film, these two films being flexible and allowing easy access to the inside of the frame. Furthermore, owing to the use of a wallet-type structure, it is extremely easy to deform it in order to insert the bill therein.

In order to solve the problem of attaching the wallet to the surround, the means for securing the wallet to the surround consist of beading which is present on all four sides of the wallet; the tensioning means consist of a channel section including two flexible tabs between which there is an opening which is smaller than the dimensions of the beading, said tabs having flexibility allowing the beading to be inserted and having stop buffers making it impossible to remove the beading if pulled.

Put another way, the four sides of the wallet are equipped with a reinforced region of the type described in the Applicant's Patent EP 0 294 301. The edges of this wallet therefore have a rod suitable forming beading intended to be held tightly in an appropriate section piece which allows it to be inserted under light pressure and prevents it from being detached without the use of an appropriate tool.

In order to make the posting of the bill easier, on the open side of the wallet the outer film bears the means for securing to the surround while the back film has additional means for attaching to the surround, these means being independent of the means borne by the front film.

In other words, at the wallet opening, the back film is kept pressed against the surround or window by any known means, such as bonding, Velcro® attachment or screwing. This provision makes it possible to open the wallet when posting the bill without the back film being free.

To make it easier for the bill to be held inside the wallet, the device has points for attaching the upper edge of the bill on the inside of the wallet.

Put another way, in order to allow precise positioning of the bill, and prevent it from shifting when it should not inside the wallet, the device in accordance with the invention includes and provides points for anchoring this bill.

In a preferred form of the invention, the wallet has its opening on the lower side, and the surround includes a device for raising said attachment points of the upper edge of the bill between a low position corresponding to the insertion of the bill and a high position corresponding to the definitive posting of the bill.

Of course the invention is not limited to the insertion of the bill from the bottom of the wallet, but also covers alternative forms in which the bill is inserted from the side.

In other words, for very tall panels, the bill is inserted from the lower side of the wallet and it is posted inside the wallet by sliding automatically inside the wallet.

In a practical embodiment, the attachment points consist of at least two hooks connected to the end of two straps capable of entering the wallet through two orifices situated at the top of said wallet, the opposite ends of said straps being fixed to a shaft which can be rotated to allow the vertical displacement of the hooks.

Thus when the bill is posted, all that is required is for the top part of the bill to be hooked onto the two hooks and for the shaft to be rotated to allow the bill to be raised to a high position.

When the invention operates by backlighting the bill, the back film is, of course, transparent.

In order to improve the esthetic appearance of the device, the surround may include elements mounted on hinges and able to pivot on the peripheral region of the wallet in order to camouflage it.

In order to solve the problem of the rigidity with which the wallet stands up to the wind, the surround may advantageously include buffer laths arranged behind the wallet.

BRIEF DESCRIPTION OF THE DRAWINGS

The way in which the invention is achieved, together with the advantages which stem therefrom will emerge clearly from the embodiment which follows in support of the attached figures in which.

Finally.

EMBODIMENT OF THE INVENTION

Figure 1:
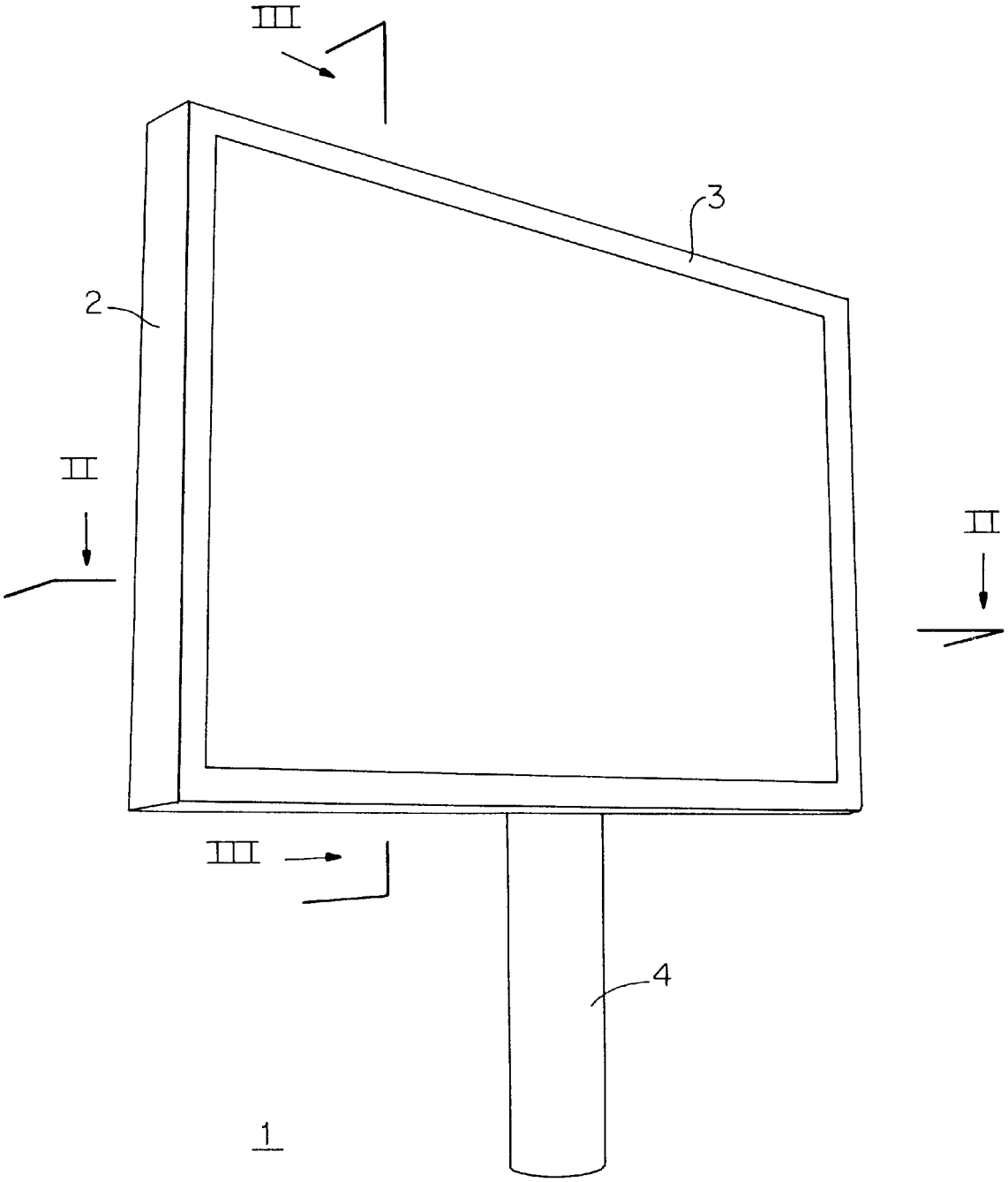
FIG. 1 is a concise perspective view of a bill posting panel in accordance with the invention.

In general, bill posting panels (1) to which the invention relates consist of a frame forming the surround (3), this surround or window being placed high up on one or two vertical uprights (4). The invention is not limited to this single embodiment but in contrast can easily be adapted for various heights, widths and supports.

Furthermore, the form illustrated constitutes a perfected version of the invention in which the bill can be backlit by virtue of lighting means (5) installed on the back face of a case (2) associated with the surround (3).

The back face of the case consists, in the conventional way, of a panel (10) made of wood or metal or the equivalent. The side faces (11, 12), the lower face (14) and the upper face (13) of this case consist of section pieces mounted on the back panel (10). The shape of these section pieces is known per se, which means that there is no need to describe them in any greater depth. The main features of the invention lie in the means of securing the bill to the case.

Figure 4:
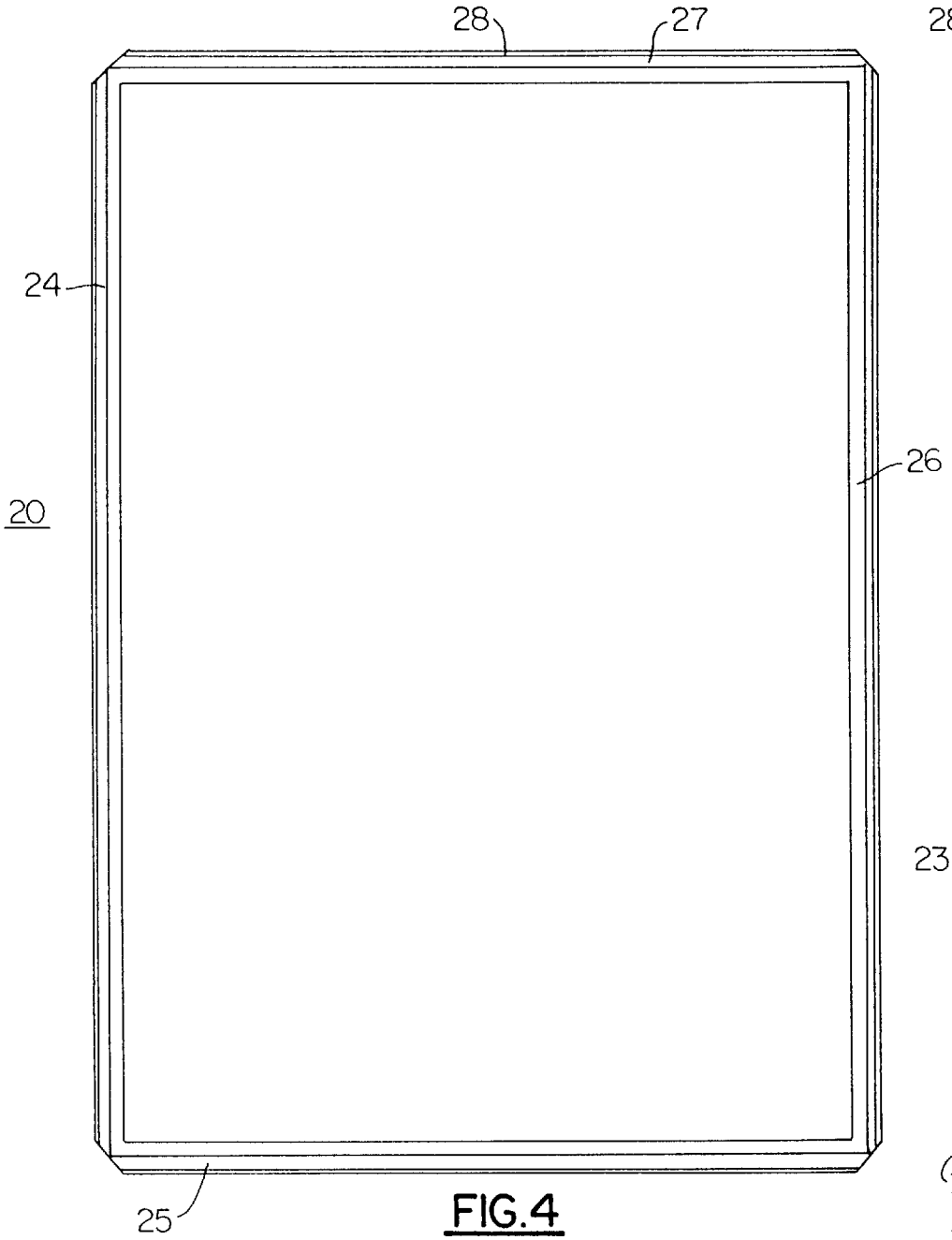
FIG. 4 is a front-on view of the wallet in accordance with the invention.
Figure 6:
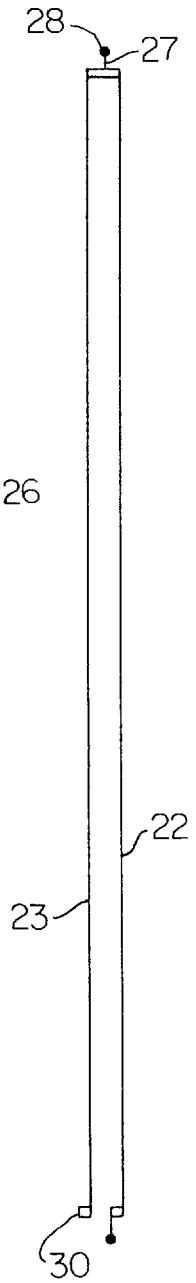
FIGS. 5 and 6 are horizontal and vertical sections of the same wallet.
Figure 5:
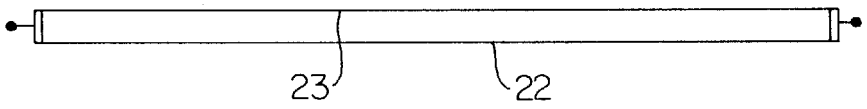

Another essential feature of the invention is the use of a wallet (20) for posting the bill (21) inside the surround (3). This wallet (20), illustrated in FIGS. 4 to 6, is essentially composed of two superposed films (22, 23) which have dimensions substantially equal to those of the surround (3) and which are secured along thee sides by any known means of welding, bonding, possibly riveting, or even, as an alternative, stitching. According to an essential aspect of the invention, the periphery of this wallet includes a reinforced region (24–27) bearing along its outer edge, a rod (28) or beading of greater thickness. More specifically, this reinforced peripheral region (24–27) may be secured to the wallet during assembly by welding the films (22, 23) together. Of course the invention also covers all the alternative ways of proceeding which arrive that the characteristic wallet, whether this be by bonding the peripheral region or by securing it any other equivalent means.

According to an important feature, on the open side of the wallet, the peripheral region (25) is secured only to the outer film (22) so as to allow the wallet to gape open. In addition, the back film (23) includes, on this open side of the wallet, a means (30) for securing to the surround (3) so as to ensure that this back film (23) is held when the wallet (20) is open. Any known means of securing, temporary or otherwise, of the bonding or of some other type, is used for this purpose.

Advantageously, attachment using a Velcro® tape, allowing precise, adjustable and infinitely reusable positioning, will be used.

In a practical embodiment, the peripheral region (24–27) and the characteristic beading are independent from one side of the wallet to another, this being in order to allow attachment to the surround one side at a time.

Attachment to the surround and tensioning of the wallet (20) take place by fitting the beading (28) inside characteristic section pieces (31) as described in Patent EP-A-0 294 301, so that it is not necessary to describe them in any greater depth. Nonetheless, it should be emphasized that this type of section piece (31) includes two flexible thin strips (32, 33) oriented toward the inside of this section piece (31) and having a certain flexibility allowing easy insertion of the rod (28) between the two thin strips (32, 33). Bearing in mind the orientation of these said is thin strips, and the presence of buffers (34, 36) linked to the section pieces (31), pulling the rod (28) outward puts load on the thin strips (32, 33) and prevents detachment. Thus, for fitting and extracting the rod (28) it is necessary to use a tool as described in the aforementioned patent.

Figure 2:
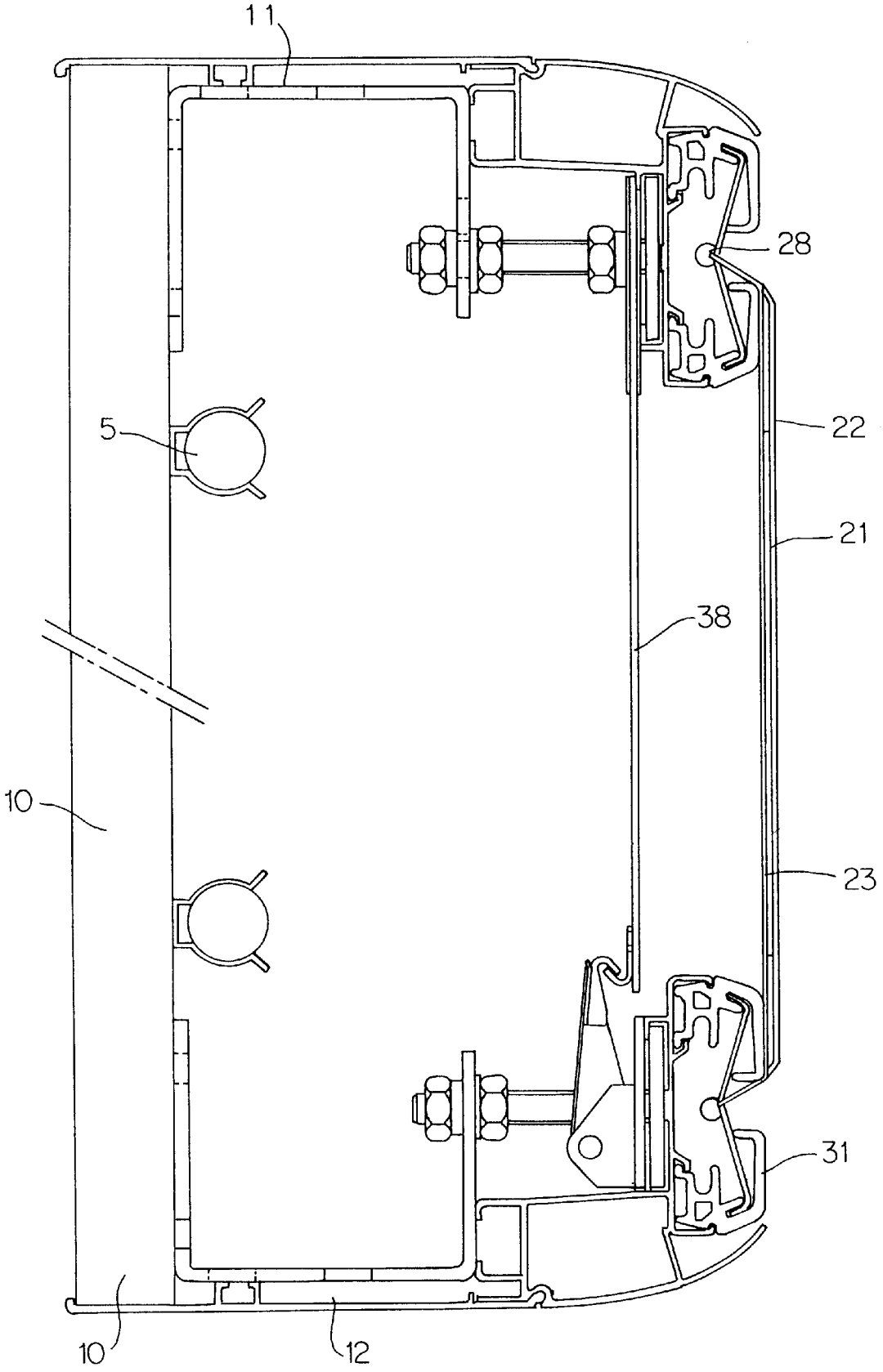
FIG. 2 is a horizontal section in the direction of the arrows II-II" of FIG. 1.
Figure 3:
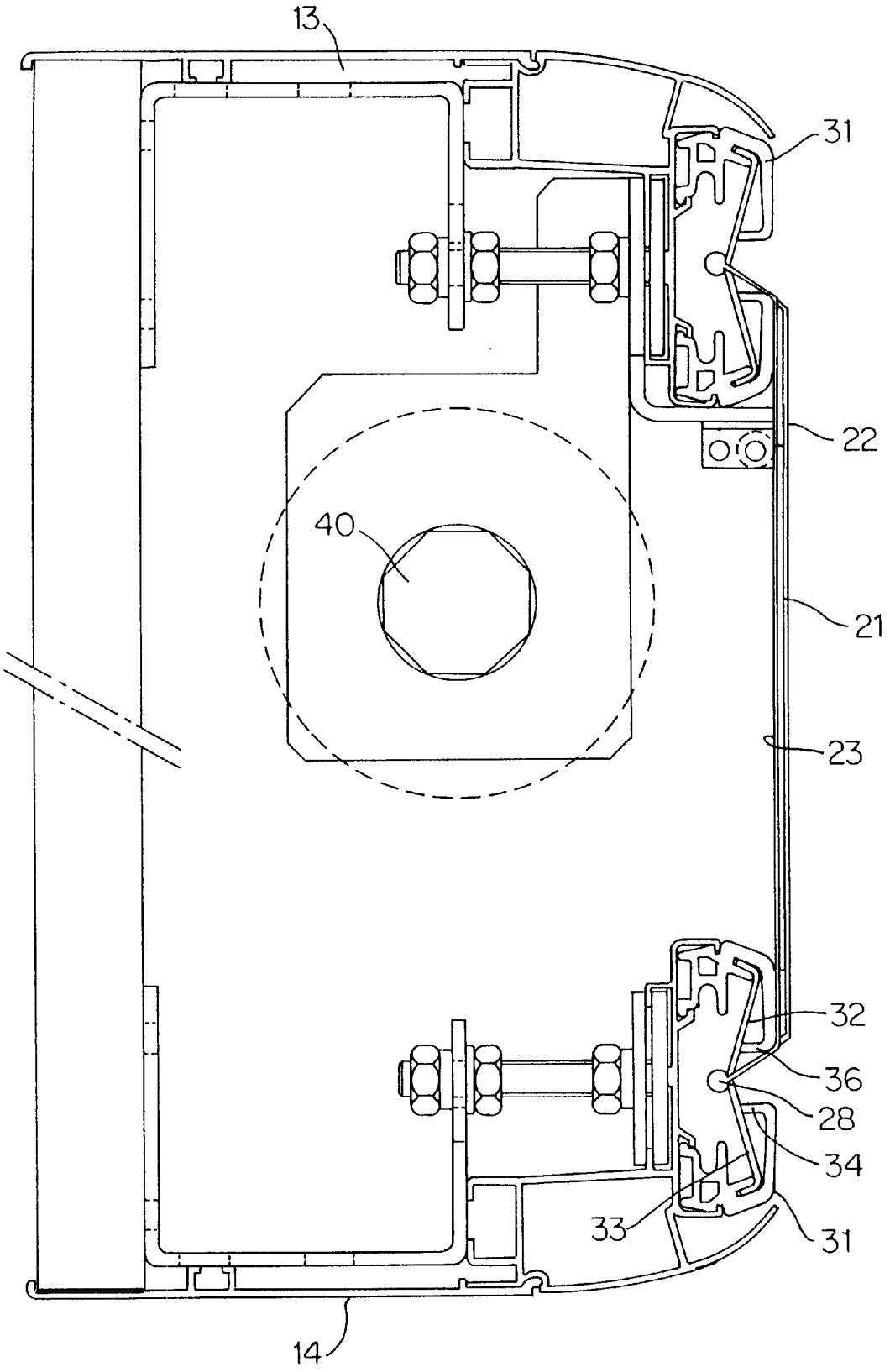
FIG. 3 is a vertical section in the direction of the arrows III-III" of FIG. 1.

When fitting the peripheral rods (28) in the surround (3), the wallet (20) is tensioned to support a bill mounted inside the wallet within a substantially flat plane as shown in FIGS. 2 and 3. Any type of accessory and auxiliary devices for tensioning the wallet may also be employed without departing from the teachings of the present invention. For example the use of peripheral regions having extending bellows, or including eyelets for the passage of an elastic cord, or any other means known elsewhere.

Advantageously, as illustrated in FIGS. 1–3, surround 3 (FIG. 1) includes, set back from the attachment section pieces, a plurality of buffer laths (38) arranged behind the wallet. Thus, if the wallet (20) is deformed on account of the wind, it is limited in its backward travel so that the risks of tearing are very limited.

Figure 7:
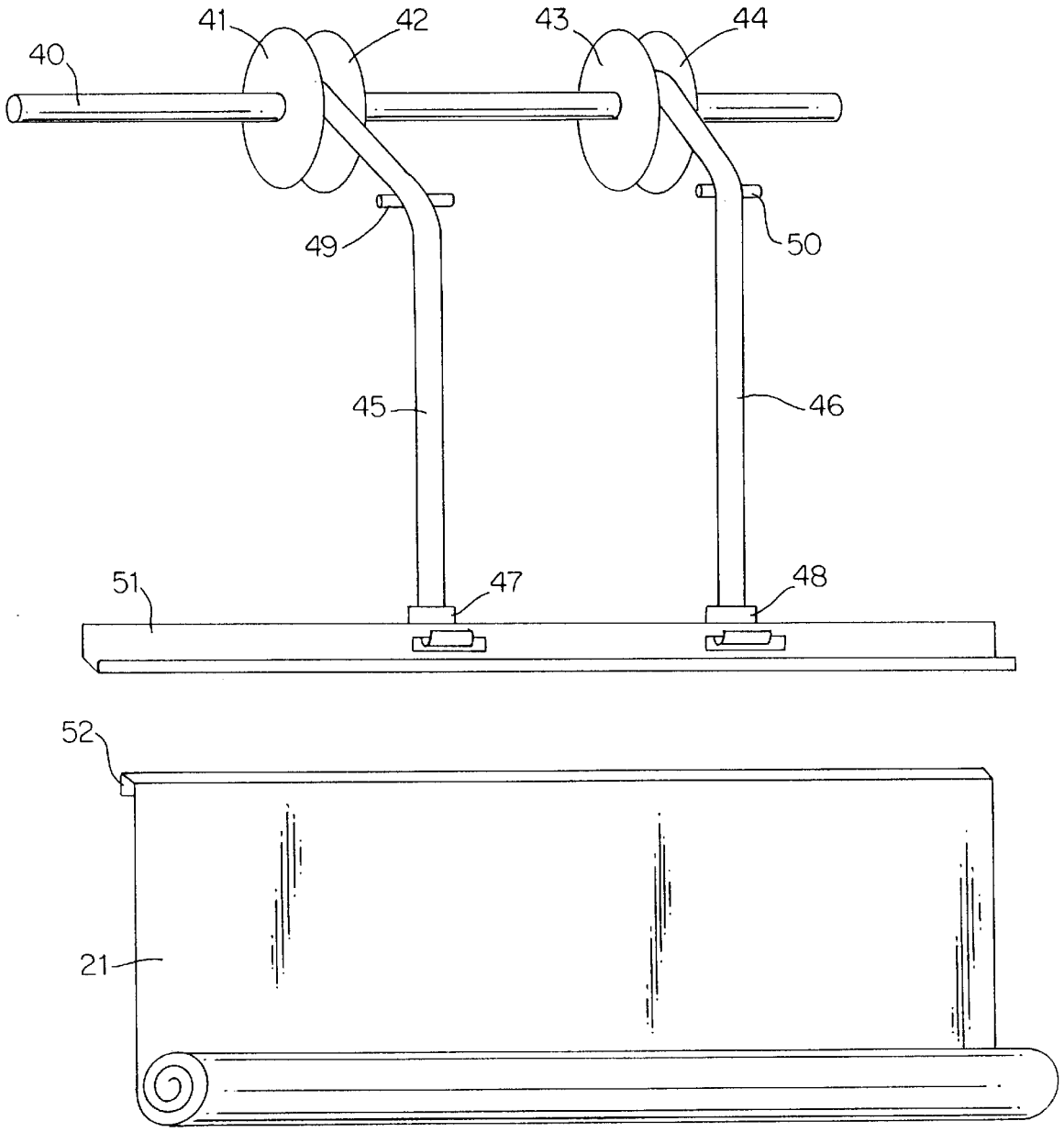
FIG. 7 is a concise perspective view of the system for raising the bill.
Figure 8:
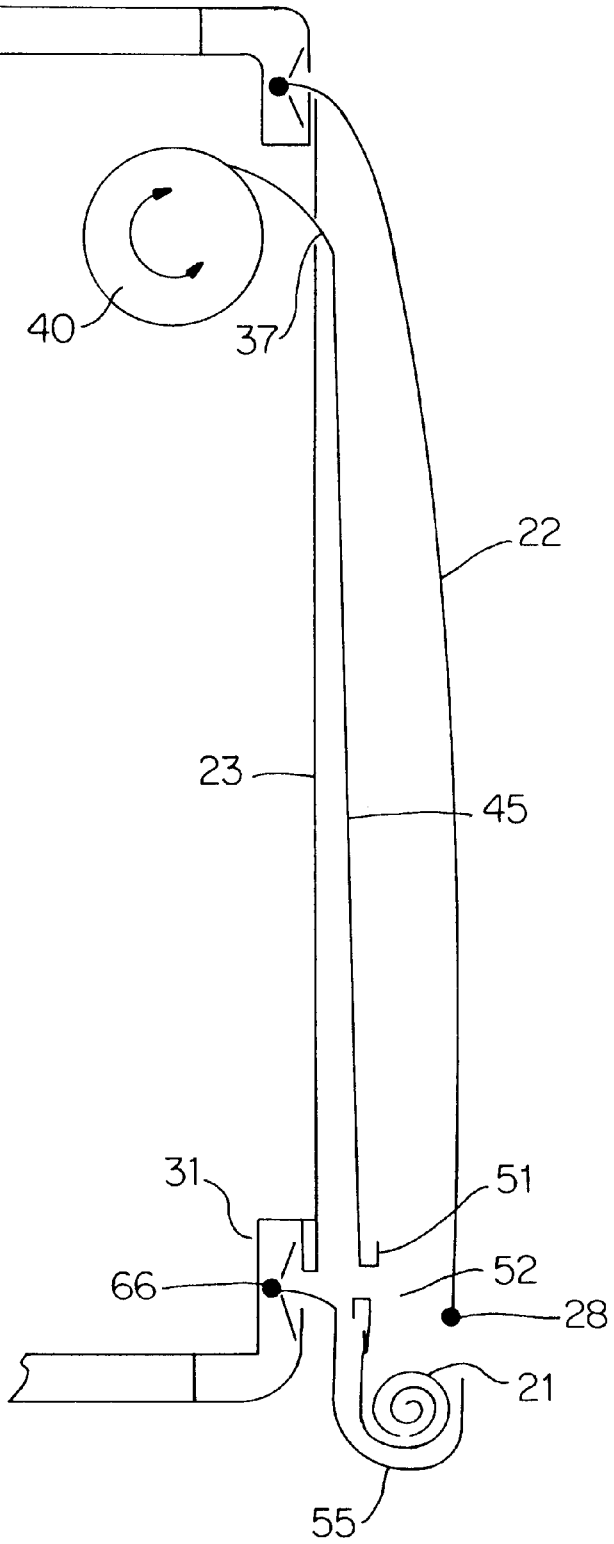
FIG. 8 is a vertical section illustrating the raising system.

As illustrated briefly in FIG. 3 and in FIGS. 7 and 8, the bill (21) may be posted inside the wallet (20) by an advantageous raising system. To this end, the case (2) comprises, in its middle region, a rotary shaft (40) on which two pairs of flanges (41–44) are mounted. Fixed between each pair of flanges is a strap (45, 46) the length of which is greater than the height of the bill. These straps are equipped with hooks (47, 48) at their free ends. The free ends of the straps slide in the plane of the wallet (20) and they are positioned by two idling pulleys (49, 50) arranged just beneath the section piece (31) forming the upper part of the surround (3). The hooks and the free parts of the straps enter the wallet through two openings made in the back film. Advantageously, these hooks support a lath (51) forming a channel section open at the top and able to slide inside the wallet (20).

This lath (51) is intended to interact with a complementary lath (52) bonded to the top back part of the bill (21).

Of course, the invention is not limited to this specific attachment type, but rather on the contrary covers all equivalent alternative forms which allow the bill to be raised inside the wallet.

The posting of the bill (21) inside the wallet (20) takes place according to the following operations.

Represented in FIG. 8 is a vertical section through the panel, in which the wallet (20) is open, just before the bill (21) is posted. It will be seen that, in accordance with what was stated earlier, the lower side of the back film (23) remains secured to the surround, and more specifically to the attachment section piece (31). By contrast, the lower side of the outer film (22) is not engaged with the attachment section piece (31) and remains free, thus allowing the wallet (20) to be opened. In parallel, the raising system has been actuated to allow the attachment lath (51) to slide downward, close to the opening in the wallet (20). Advantageously, this shaft (40) may be rotated by maneuvering a crank, or preferably by the action of a portable rotary tool, of the drill type.

In a preferred form, the bill (21) is installed pre-rolled inside a trough (55) which has means (66) for placing and attaching it in the lower section piece (31) of the surround, which avoids the operator having to hold the bill (21) and allows him easily to fit the lath (52) of the bill over the attachment lath (51) of the panel.

When this attachment has been carried out, the operator raises the straps (45, 46) by rotating the shaft (40) until the bill reaches its definitive high position. All that remains for him to do is to extract the bill-holder trough (55) and reinsert the beading (28) of the lower side of the wallet (20) into the corresponding section piece (31). Thus the wallet (20) is tensioned again, and the bill (21) is pressed out inside the wallet (20).

Of course, this posting method may be replaced by any less sophisticated way of posting the bill, especially the one described by the use of a spatula in Patent EP 0 646 904.

Figure 9:
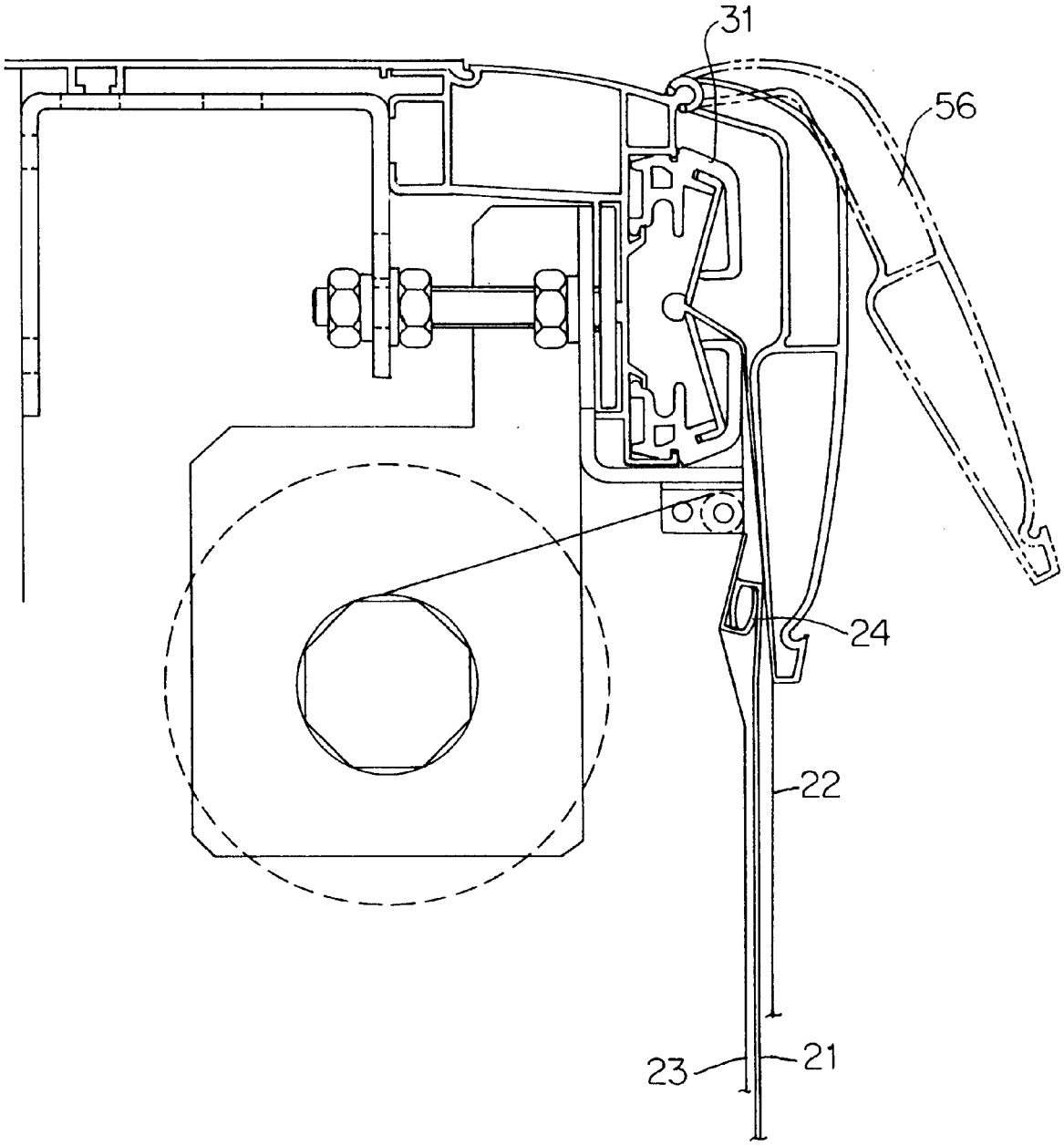
FIG. 9 is a detail section of the pivoting camouflage elements which border the wallet.

In an esthetic alternative form of the invention, it is possible to choose to camouflage the peripheral regions (24–27) of the wallet, and those of the bill, by the use of additional components (56) which are mounted so that they can pivot on the surround (3) and which are intended to cover the region (24–27) to be camouflaged. This alternative form is illustrated in FIG. 9, in which a solid line has been used to show the pivoting component (56) in the closed position, and a dotted line has been used to show the same component in the open position allowing the bill to be posted.

It emerges from the foregoing that the bill posting panel in accordance with the invention displays the following notable advantages:

optimum mechanical behavior, especially under all wind conditions, thanks to the use of two deformable plastic films pressed in front of and behind the bill, which encapsulates the bill;

complete imperviousness of the wallet, which guards the bill against any ingress of water;

good behavior of the bill with regard to variations in hygrometry, thanks to the use of the two plastic films;

the use of a plastic film allows the use of means for hanging the bill using laths without giving rise to excessive deformation of the wallet;

optimum mechanical behavior, especially under all wind conditions thanks to the use of two deformable plastic films pressed in front of and behind the bill, which encapsulates the bill;

complete imperviousness of the wallet, which guards the bill against any ingress of water;

good behavior of the bill with regard to variations in humidity, thanks to the use of the two plastic films;

the use of a plastic film allows the use of means for hanging the bill using laths without giving rise to excessive deformation of the wallet;

in the version using backlighting of the bill, the absence of elements situated between the lighting means and the back face of the bill ensures that the lighting quality and the image quality remain optimum.

We claim:

1. A bill posting apparatus that includes a frame having a window means for containing a bill, a transparent flexible outer film for protecting a bill mounted in the window means, a flexible back film mounted in said window means behind the outer film for forming a deformable wallet with said outer film, said wallet being closed on three sides for containing a bill therein and further containing one open side though which said bill is insertable into said wallet, said wallet having a reinforced peripheral region along the three closed sides and securing means for attaching said three closed sides to the window means, and said window means further including tensioning means that interacts with the securing means to tension the wallet within said window so that a bill mounted in said wallet is supported within a flat plane within said window.

2. The apparatus of claim 1 wherein the securing means further includes beading along all four sides of the wallet and said tensioning means further consists of a channel section having two flexible tabs between which there is an opening which is smaller than the dimension of the beading, said tabs having a flexibility to allow the beading to be inserted therein and containing buffers for retaining the beading with said tabs.

3. The apparatus of claim 2 wherein the outer film contains the securing means on the open side of the wallet and the back film on the open side of the wallet has additional means for securing the wallet to the window means, said additional means being independent of said securing means on the outer film.

4. The apparatus of claim 1 wherein said bill includes attaching points along its upper edge for removable attaching the bill to a coacting mechanism inside the wallet.

5. The apparatus of claim 1 wherein the wallet has the open side at its lower edge and the window means includes a mechanism for engaging attachment points on the upper edge of a bill, and raising the hill between a first lower position wherein the bill is inserted into the wallet and a second position wherein the bill is posted within the window.

6. The apparatus of claim 5 wherein the attachment points consist of at least one hook connected to the end of each of a plurality of straps arranged to enter the wallet through orifices located at the top of said wallet, the opposite ends of said straps being connected to a shaft for vertically displacing the straps and thus raising or lowering a bill in the wallet.

7. The apparatus of claim 1 wherein said frame includes backlighting means and said back film is transparent to pass backlighting.

8. The apparatus of claim 1 wherein the window means includes hinged elements for pivoting onto the peripheral regions of the wallet to mask said regions.

9. The apparatus of claim 1 wherein said window means includes buffer lathes mounted behind the wallet.

* * * * *

UNITED STATES PATENT AND TRADEMARK OFFICE

CERTIFICATE OF CORRECTION

PATENT NO. : 5,896,689

DATED : April 27, 1999

INVENTOR(S) : Bassouls et al.

It is certified that error appears in the above—identified patent and that said Letters Patent is hereby corrected as shown below:

Col. 6, Line 48, please delete the word "hill" and insert -- bill --.

Signed and Sealed this

Thirty-first Day of August, 1999

*Attest:*

Q. TODD DICKINSON

*Attesting Officer*

*Acting Commissioner of Patents and Trademarks*